US005404804A

United States Patent [19]

Aoyama

[11] Patent Number: 5,404,804

[45] Date of Patent: Apr. 11, 1995

[54] OFFSET PRINTING MACHINE WITH NUMBER PRINTING FUNCTION

[75] Inventor: Hideo Aoyama, Fuchu, Japan

[73] Assignee: Ryobi Limited, Hiroshima, Japan

[21] Appl. No.: 154,302

[22] Filed: Nov. 18, 1993

[30] Foreign Application Priority Data

Dec. 28, 1992 [JP] Japan ..... 4-349108

[51] Int. Cl.[6] ..... B41F 1/16

[52] U.S. Cl. ..... 101/76

[58] Field of Search ..... 101/72, 74, 76, 77, 101/177, 178, 220

[56] References Cited

U.S. PATENT DOCUMENTS

| | | | |
|---|---|---|---|
| 4,394,835 | 7/1983 | Gertsch et al. | 101/220 |
| 4,676,156 | 6/1987 | Aylor et al. | 101/148 |
| 5,178,678 | 1/1993 | Koehler | 101/178 |

FOREIGN PATENT DOCUMENTS

| | | | |
|---|---|---|---|
| 0275025 | 7/1988 | European Pat. Off. | 101/76 |
| 559106 | 2/1975 | Switzerland | 101/76 |
| 0251347 | 4/1926 | United Kingdom | 101/76 |
| 705215 | 3/1954 | United Kingdom | 101/76 |
| 2073101 | 10/1981 | United Kingdom | 101/76 |
| 2150079 | 6/1985 | United Kingdom | 101/76 |

*Primary Examiner*—Eugene H. Eickholt
*Attorney, Agent, or Firm*—Brooks & Kushman

[57] ABSTRACT

A number printing unit for an offset printing machine in which blocks are fixed to a numbering unit mounting holder provided rotatably on an operation side frame. Coupling retainer blocks are inserted into groups formed in the blocks. The coupling retainer blocks are mounted on the numbering unit mounting holder by screws, washers and bolts. A gear is rotatably mounted on the numbering unit mounting holder through a bearing. A coupling ring is fixed to the gear by screw. Abutment portions of the coupling retainer blocks are brought into contact with the coupling ring.

3 Claims, 3 Drawing Sheets

OFFSET PRINTING MACHINE WITH NUMBER PRINTING FUNCTION

BACKGROUND OF THE INVENTION

The present invention relates to an offset printing machine with a number printing function, and more particularly to an offset printing machine which is capable of selectively effecting a number print.

An offset printing machine with a number printing function is well known in this field. In some of the conventional printing machines with a number printing function, even in the case where no number print is necessary, it is impossible to dismount a number printing unit.

In offset printing machines which are of a detachable type, in the case where number printing is unnecessary, the number printing unit is removed from the printing machine not to effect the number print. In offset printing machines which are not of a detachable type, even in the case where the number pint is unnecessary, the numbering unit must be operated.

However, even in the numbering unit detachable type printing machine, in the case where the numbering unit is to be dismounted from the machine, the removal work is complicated, and when the numbering unit is again mounted on the machine, it takes a long time to mount the numbering unit in the same position. Also, a special holder station is needed for keeping the removed numbering unit. Furthermore, in the non-detachable type printing machine, since the numbering unit is driven irrespective of the necessity of the numbering print, the numbering unit is driven, resulting in a problem such as frictional wear in mechanical components such as rollers and bearings. Also, there is a fear that an unnecessary load would be imposed on the printing machine as a whole due to the driving operation of the numbering unit.

SUMMARY OF THE INVENTION

Accordingly, in view of the foregoing defects inherent in the prior art printing machines, an object of the present invention is to provide an offset printing machine with a number printing function which is not dismounted from the printing machine even in the case where the number printing is unnecessary and which is not operated in vain when the number printing is unnecessary.

In order to attain this and other objects of the invention, according to the present invention, there is provided an offset printing machine with a number printing function, having a numbering unit and an offset printing unit, comprising a numbering unit mounting shaft for holding the numbering unit, a first gear provided coaxially with the numbering unit mounting shaft and rotatable independently of the numbering unit mounting shaft, a second gear engaged with the first gear and provided in the offset printing unit, and a rotational torque transmission mechanism for transmitting/interrupting a rotational torque of the first gear relative to the numbering unit mounting shaft.

In case of number printing, the rotational torque transmission mechanism is kept under a torque transmission condition. Then, when the second gear of the offset printing unit is rotated, the first gear is also rotated to transmit the rotational torque of the first gear to the numbering unit mounting shaft through the rotational torque transmission mechanism. Thus, the numbering unit mounting shaft is rotated to thereby effect the number printing.

In case of no number printing, the rotational torque transmission mechanism is kept under a no torque transmission condition. Then, the first gear is rotated in accordance with the rotation of the second gear of the offset printing unit. At this time, since the rotational torque transmission mechanism is kept under a no torque transmission condition, the numbering unit mounting shaft is not rotated. Therefore, the numbering unit is not driven and the number printing is not effected.

DESCRIPTION OF THE PREFERRED EMBODIMENTS

The present invention will now be described by way of example with reference to the accompanying drawings.

Figure 1:
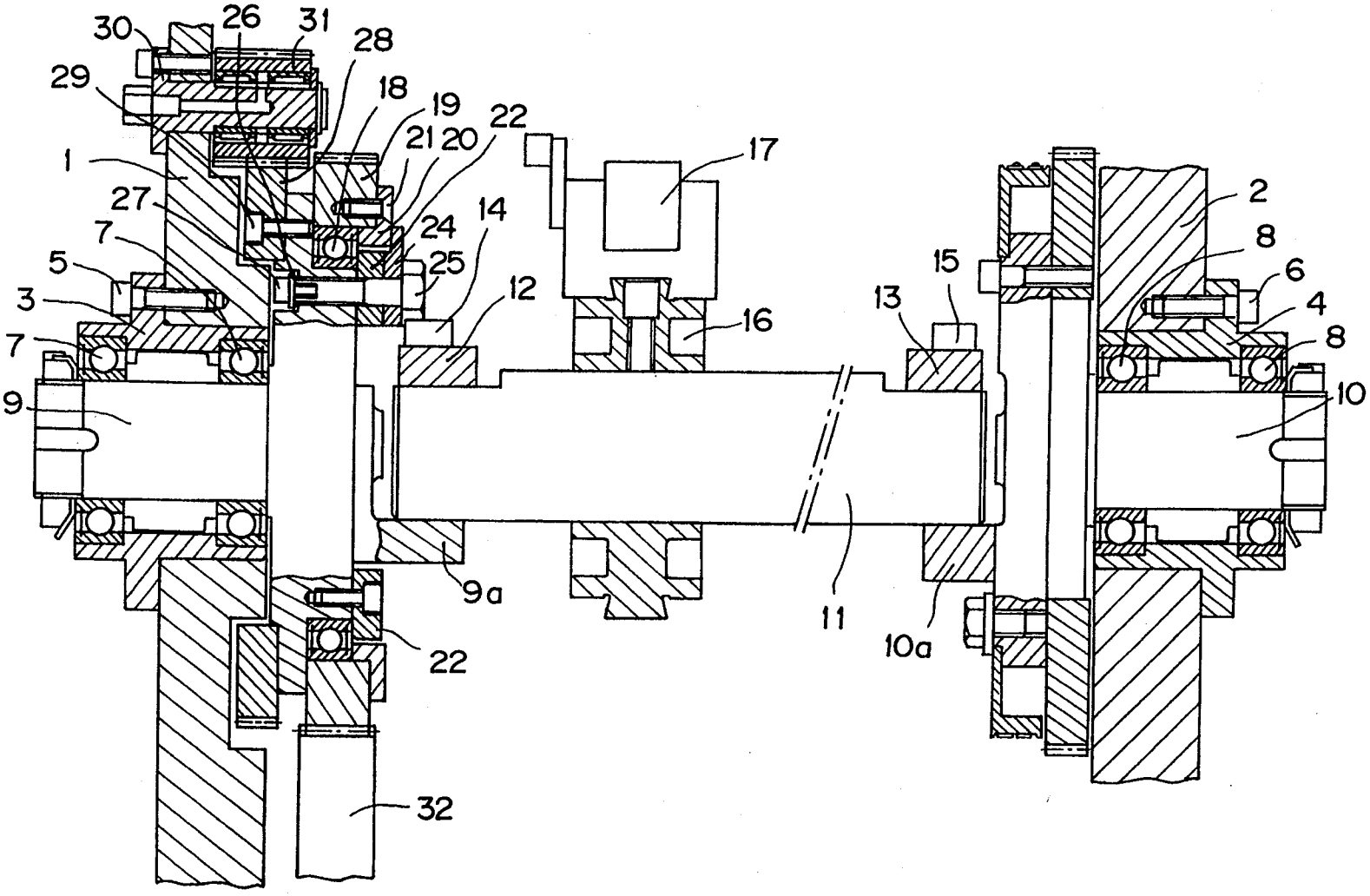
FIG. 1 is a cross-sectional view showing a numbering unit of an offset printing machine according to the invention.
Figure 2:
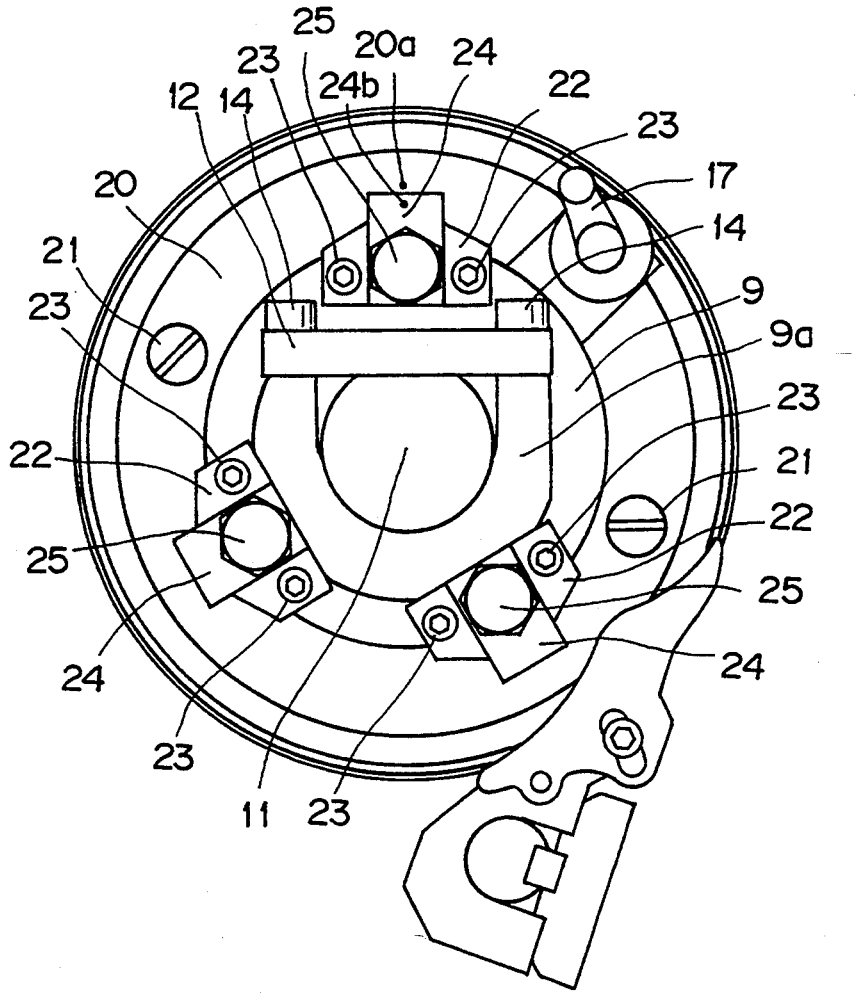
FIG. 2 is a side elevational view showing the numbering unit shown in FIG. 1.

FIG. 1 is a cross-sectional view showing a numbering unit of an offset printing machine according to the invention. Reference numeral 1 denotes an operation side frame opposite to a non-operation side frame 2. The operation side frame 1 and the non-operation side frame 2 are fixed in place by holders 3 and 4 through screws 5 and 6, respectively. Numbering unit mounting holders 9 and 10 are rotatably mounted on the holders 3 and 4 through bearings 7 and 8, respectively. Retainers 9*a* and 10*a* (one of which is shown in FIG. 2 to have a U-shape as seen from a front side) are formed at facing sides of the two numbering unit mounting holders 9 and 10, respectively. Opposite ends of a numbering unit mounting shaft 11 are held at the retainers 9*a* and 10*a*, respectively (see FIG. 1). Mounting shaft fastening plates 12 and 13 (see FIG. 1) are each provided between opposite ends of each U-shaped retainer 9*a*, 10*a* (see FIG. 1) and are fixed by screws 14, 15 (see FIG. 1). Further with reference to FIG. 1, a numbering unit 17 is fixed to the numbering unit mounting shaft 11 through a numbering unit mounting holder 16.

Figure 3:
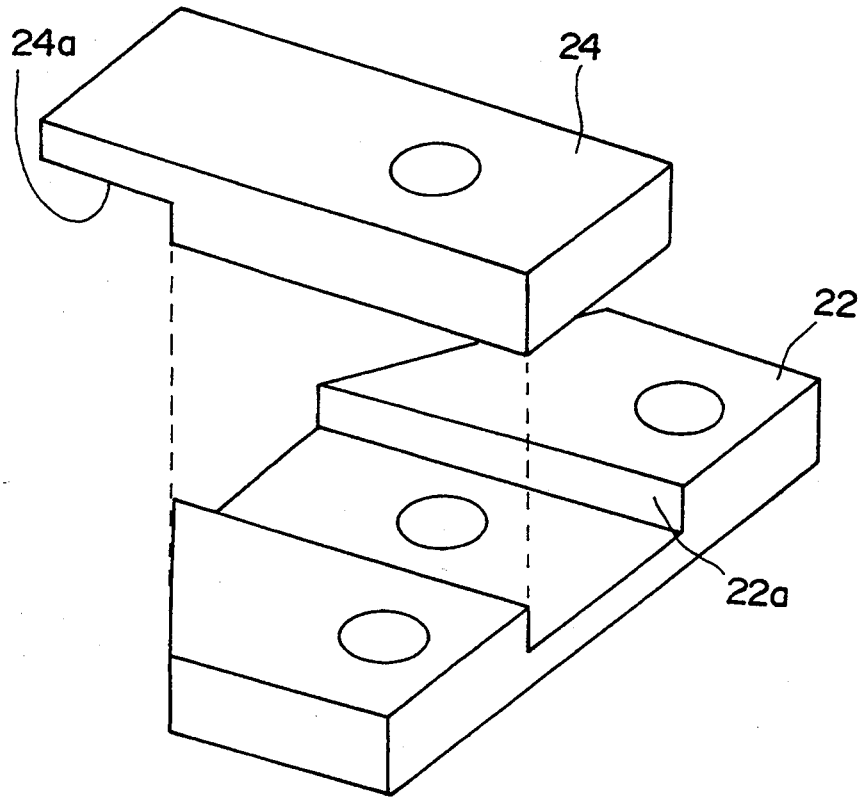
FIG. 3 is a perspective view showing a block and a coupling retainer block of the offset printing machine shown in FIG. 1.

A gear 19 is rotatably provided through a bearing 18 on the right side of the numbering unit mounting holder 9 in FIG. 1 in the operation side frame 1. A coupling ring 20 is fixed by a screw 21 on the right side of the gear 19 in FIG. 1. On the other hand, in FIG. 2, three blocks 22 each having a shape as best shown in FIG. 3 are fixed by screws 23 to the numbering unit mounting holder 9. Further as shown in FIG. 3, coupling retainer block 24 is inserted into a groove 22*a* of the block 22. As best shown in FIG. 1, a screw 25 penetrates the coupling retainer block 24, the block 22 and the numbering unit mounting holder 9. A bolt 27 is threadedly engaged through a washer 26 with a tip end of the screw 25 for preventing the screw 25 from falling from the holder 9. An abutment portion 24*a* is formed on each coupling retainer block 24 for pressing the coupling ring 20.

A gear 28 is fixed by a screw 29 on the left side of the numbering unit mounting holder 9 in FIG. 1 in the operation side frame 1. An ink supply unit driving unit 31 rotatably held at a holder 30 provided on the operation side frame 1 is engaged with the gear 28 to drive a conventional ink supply roller (not shown).

The operation of the thus constructed offset printing machine with the numbering unit will be explained.

In case of the numbering print, the screws 25 are fastened so that the abutment portions 24*a* of the coupling retainer blocks 24 press the coupling ring 20 to thereby avoid the slippage between the coupling ring 20 and the abutment portions 24*a*. When the offset printing machine is operated under this condition, the gear 32 of the offset printing unit engaged with the gear 19 is rotated to thereby rotate the gear 19. In accordance with the rotation of the gear, the coupling ring 20 is also rotated. The rotation of the coupling ring 20 causes the coupling retainer blocks 24 to rotate through the abutment portions 24*a*. Thus, the numbering unit mounting holder 9 is rotated, and the numbering unit 17 is rotated through the numbering unit mounting shaft 11 and the numbering unit mounting holder 16. In accordance with the rotation of the numbering unit mounting holder 9, the ink supply unit driving gear 31 is rotated through the gear 28. As a result, the ink supply unit (not shown) is operated to supply the numbering unit 17 with ink. Thus, the number printing is effected.

Also, in case of no number printing, in FIG. 1, the screws 25 are loosened. Then, the coupling ring 20 and the abutment portions 24*a* of the coupling retainer blocks 24 are not firmly coupled with each other, resulting in generation of slippage therebetween. When the offset printing machine is operated under this condition, the gear 19 is rotated in accordance with the rotation of the gear 32. However, the coupling retainer blocks 24 are not firmly abutted against the coupling ring 20 although the coupling ring 20 is rotated by the rotation of the gear 19, the rotational torque of the coupling ring 20 is not transmitted to the coupling retainer blocks 24 and hence it is not transmitted to the numbering unit mounting holder 9. Therefore, the numbering unit 17 is not rotated and the numbering unit 17 is not operated.

In the case where the screws 25 are again fastened or tightened after the screws 25 have been loosened, there is a fear that the circumferential positions of the coupling ring 20 and the coupling retainer blocks 24 would not be identical with each other. However, in this case, in FIG. 2, a mark 20*a* provided on the coupling ring 20 is aligned with a mark 24*b* provided on the coupling retainer block 24 to thereby complete the positional adjustment.

As described above, according to the present invention, in case of the number printing, the numbering unit is operated, and in case of no number printing, the numbering unit itself is not driven. It is therefore possible to reduce a frictional wear of mechanical components such as rollers and bearings. Also, in case of no number printing, since the ink roller is not rotated, it is possible to prevent a generation of an unnecessary load to be imposed on the printing machine. Also, since the numbering unit is not dismounted from the printing machine, it is easy to switch over the operation and non-operation of the printing unit.

What is claimed is:

1. An offset printing machine with a number printing function, having a numbering unit and an offset printing unit, comprising:

a numbering unit mounting shaft for holding the numbering unit;

a first gear provided coaxially with said numbering unit mounting shaft and rotatable independently of the numbering unit mounting shaft;

a second gear engaged with said first gear and provided in the offset printing unit; and a rotational torque transmission mechanism for transmitting/interrupting a rotational torque of the first gear relative to the numbering unit mounting shaft, said rotational torque transmission mechanism including a coupling ring attached to said first gear and a block means rotated together with said numbering unit mounting shaft.

2. The offset printing machine according to claim 1, further comprising an ink supply unit driving gear rotated together with said first gear for driving an ink roller for supplying said numbering unit with ink.

3. The offset printing machine according to claim 1, wherein said block means includes three block units each having an abutment which may be firmly contacted with said coupling ring.

* * * * *